United States Patent [19]

Dyer

[11] Patent Number: 4,548,012

[45] Date of Patent: Oct. 22, 1985

[54] COLLAPSIBLE FRAMEWORK

[75] Inventor: David C. Dyer, Enfield, United Kingdom

[73] Assignee: Paul Weston, London, England

[21] Appl. No.: 570,422

[22] Filed: Jan. 13, 1984

Related U.S. Application Data

[63] Continuation of Ser. No. 302,543, Sep. 16, 1981.

[51] Int. Cl.[4] ..... A47B 43/00; A47F 5/00; E04H 12/18; E04B 1/346

[52] U.S. Cl. ..... 52/646; 52/66

[58] Field of Search ..... 52/66, 646

[56] References Cited

U.S. PATENT DOCUMENTS 1,170,188 2/1916 Rasmussen et al. ..... 52/641

1,300,621 4/1919 Key ..... 5/114

4,354,331 10/1982 Dyke ..... 52/66

FOREIGN PATENT DOCUMENTS 2055290 3/1981 United Kingdom ..... 211/195

*Primary Examiner*—James L. Ridgill, Jr.

*Attorney, Agent, or Firm*—Kemon & Estabrook

[57] ABSTRACT

A multipurpose collapsible structure which may be used, for example, as a display stand or as a storage rack. The structure comprises four rectangular frames 2, 3, 4 and 5, defining a rectangular enclosure. The two opposite upright frames 2 and 4 have outwardly projecting bracket 12 which slide over the upper long sides of the other frames. The upright frames are pivoted at their bases enabling the structure to be collapsed, firstly to an oblique structure and then to a substantially flat state.

1 Claim, 4 Drawing Figures

COLLAPSIBLE FRAMEWORK

This application is a continuation of application Ser. No. 302,543, filed 9-16-81.

DESCRIPTION

This invention relates to collapsible structures intended for example for the display of advertisement material or as a storage rack. The invention is not however limited by its purpose and the inventor conceives that at least some of the collapsible structures according to the invention will each be capable of a number of different uses.

One object of the present invention is to provide a collapsible structure that can be collapsed into a flat state without necessitating the disconnection of the parts of the structure.

According to the present invention there is provided:

a collapsible structure comprising at least four rectangular members, each defining a rectangular wall and connected in succession to form an enclosure, each rectangular member being pivotally connected to a successive rectangular member, and at least one of the rectangular members having at least one channel section portion within which an adjacent one of the rectangular members is slidably mounted to enable the structure to be collapsed to a generally flat state.

In a preferred form the rectangular members are provided by rectangular frames.

The channel section portion may comprise a bracket pivotally mounted on one of said frames.

Embodiments of the invention will now be described, by way of example only, with reference to the accompanying drawings.

Figure 1:
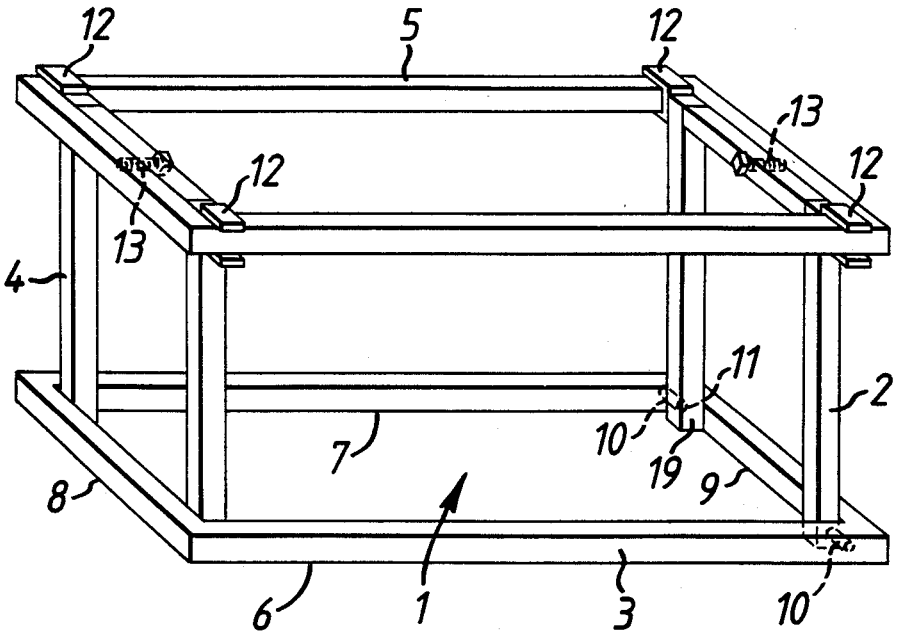
FIG. 1 is a view of a collapsible framework in its assembled state.

Referring to FIG. 1 in its assembled state a rectangular enclosure 1 is formed from four rectangular frames, 2, 3, 4, and 5. The oppositely disposed frames of the enclosure have the same shape and size. The pair of frames 2 and 4 are square in shape while the pair of frames 3 and 5 have a pair of edges 6, 7 longer than the pair of edges 8, 9 along which the frames 2 and 4 are disposed. The length of the edges 8, 9 is just slightly longer than the lengths of the sides of the frames 2 and 4, to enable the sides of the frames 2 and 4 to fit within the long sides of the frames 3 and 5. The length of the edges 6, 7 is greater than twice that of the length of the sides of the frames 2 and 4.

Each of the frames 3 and 5 comprises four lengths of tubular metal of square cross-section, while frames 2 and 4 comprise three such lengths. The lower ends 19 of the vertical portions of the frames 2 and 4 fit within the two longer sides of the lower frames 3. Each of these projecting ends 19 has a laterally outwardly projecting pin 10 which engages in a hole 11 in the inward facing surface of the corresponding long side of the lower frame 3. Each of the frames 2 and 4 can thus pivot about the axis through their respective pins 10.

The upper ends of the vertical portions of the frames 2 and 4 are square with their upper horizontal portions, so that these upper horizontal portions lie within the frame 5 flush with the short sides of that upper frame 5.

Figure 2:
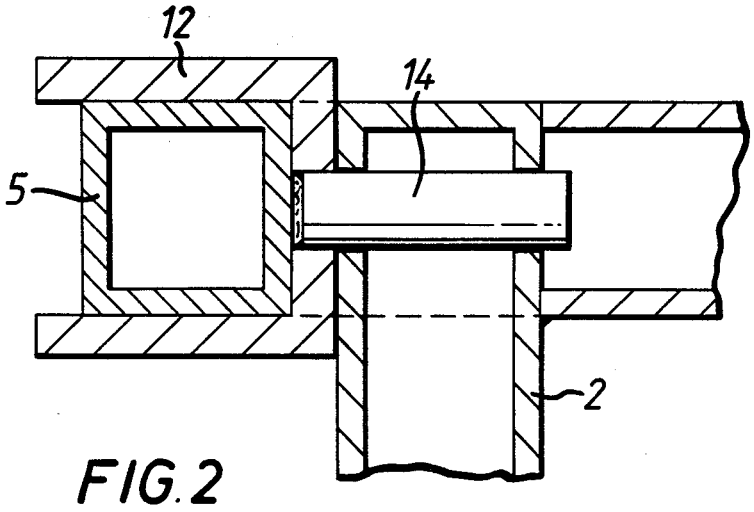
FIG. 2 is a vertical sectional view through part of the framework.

The upper ends of the vertical portions of the frames 2 and 4 have respectively a laterally outwardly projecting bracket 12. The brackets 12 extend around the long sides of the frames 5 and can slide over these sides. The brackets 12 are pivotally fixed to the vertical portions of the frames 2 and 4 by pivot pins 14 extending through holes through the sides of these frame portions, as shown in FIG. 2.

In the assembled state sliding of the brackets 12 over the long sides of the frame 5 is prevented by a locking screw 13 on the upper horizontal lengths of the frames 2 and 4. The locking screws engage with corresponding bores in the shorter length of the upper frame 5.

The structure may be collapsed when the locking screws 13 are released. The structure may be brought to a partially collapsed condition, as shown in FIG. 3, by sliding the brackets 12 of the frame 2 over the opposite long sides of the frame 5, the change in disposition of these sides being accommodated by the rotation of the pins 14.

Figure 4:
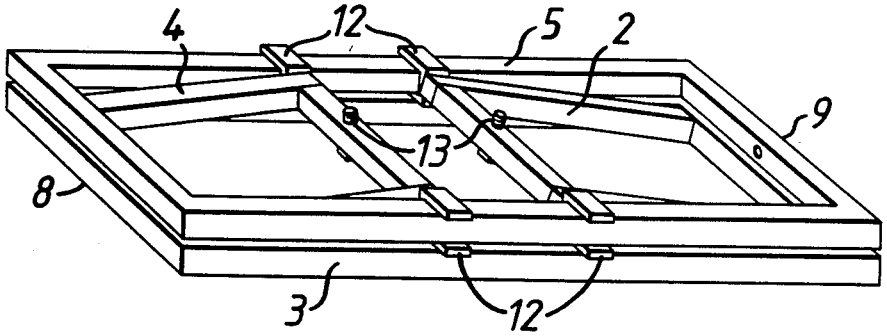
FIG. 4 is a view of the framework in a fully collapsed state.

Full collapse, as shown in FIG. 4, is achieved by sliding the brackets 12 connected to the frame 4 over the frame 5 so that the whole assembly folds down into a flat structure.

One particular application of the invention is to a filing or storage rack, where a framework substantially similar to that shown in the Figures may be provided. The framework may for example have a length of 2 meters, thus constituting the height of the rack when it is in its operative disposition. The rack may be collapsed into a substantially flat structure with a height of a few centimeters. The long sides of the framework are conveniently provided with guides to enable drawers to be inserted when the framework is erected. The framework may also be particularly useful in racking electronic equipment. A plastics box surround may be provided to form a working surface on the framework, and then the framework is conveniently collapsed into the box for transport and storage.

Figure 3:
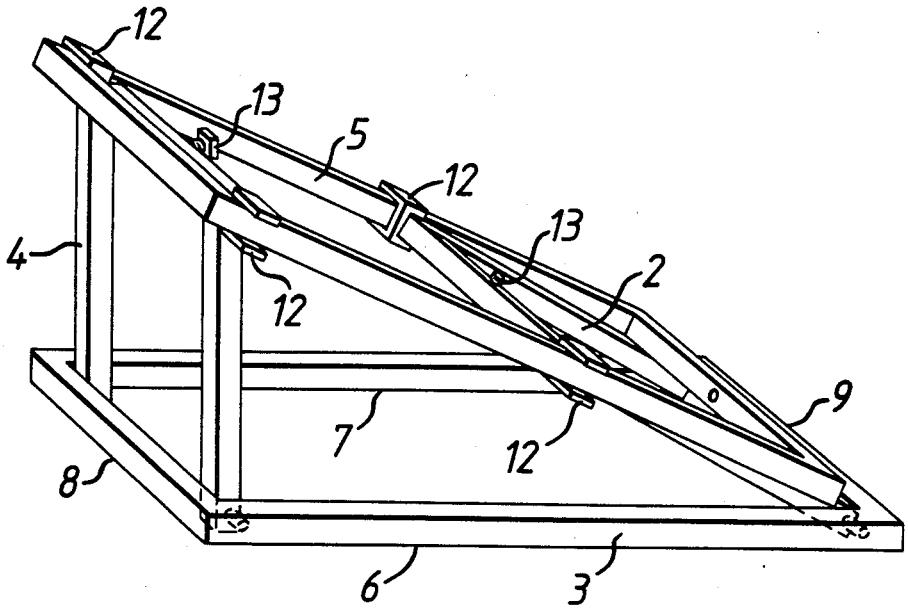
FIG. 3 is a view of the framework of FIG. 1 in a partially collapsed state.

On a smaller scale the apparatus may be used for displaying advertising or other printed matter, and in this application the partially collapsed state shown in FIG. 3 may be used.

It is envisaged that the apparatus will be particularly useful as a multi-purpose tool.

I claim:

1. A collapsible structure comprising at least four rectangularly shaped frame members connected to define an enclosure, one of said rectangularly shaped members constituting a bottom frame member and another rectangularly shaped member constituting an upper frame member with the remaining rectangularly shaped members constituting end frame members, said bottom and upper frame members each consisting of a pair of spaced parallel side elements joined together at their respective ends by end elements, said end frame members each consisting of a pair of spaced parallel side elements joined at one end by an end element disposed in a plane normal to the plane of the spaced parallel side elements, pin means mounted in and projecting outwardly from the side elements of said end frame members remote from said end element, said outwardly projecting portion of said pin means pivotally mounted in an end portion of the spaced parallel side elements of said bottom frame member, said end element of each of said end frame members having a U-shaped bracket pivotally mounted on the respective ends thereof by pins extending through the base of each bracket and projecting into the respective ends of said end element, said open end of said brackets projecting over the side elements of said upper frame member whereby said brackets are capable of sliding movement along the side elements of said upper frame member towards the center of said upper frame member contemporaneous with the pivoting of the end frame members about the pins in the side elements of said bottom frame member and fastening means carried by the end element of said end frame members and engagable with the end elements of said upper frame member for maintaining said bottom and upper frame members in locking engagement with said end frame members.

* * * * *